US008045879B2

(12) United States Patent
Bisset

(10) Patent No.: US 8,045,879 B2
(45) Date of Patent: Oct. 25, 2011

(54) METHODS FOR CONTROLLING ENVIRONMENTAL CONDITIONS IN AN ELECTROPHOTOGRAPHIC APPARATUS AND A CORRESPONDING ELECTROPHOTOGRAPHIC APPARATUS

(75) Inventor: Douglas Bisset, Stevenage (GB)

(73) Assignee: Xerox Corpoation, Norwalk, CT (US)

( * ) Notice: Subject to any disclaimer, the term of this patent is extended or adjusted under 35 U.S.C. 154(b) by 485 days.

(21) Appl. No.: 12/208,685

(22) Filed: Sep. 11, 2008

(65) Prior Publication Data

US 2010/0061756 A1 Mar. 11, 2010

(51) Int. Cl.
*G03G 21/20* (2006.01)

(52) U.S. Cl. ..... 399/97

(58) Field of Classification Search ..... 399/97, 399/94, 29, 258, 98, 44

See application file for complete search history.

(56) References Cited

U.S. PATENT DOCUMENTS

| | | | | |
|---|---|---|---|---|
| 5,530,523 | A * | 6/1996 | Kawabata | 399/44 |
| 6,337,957 | B1 * | 1/2002 | Tamaki et al. | 399/29 |
| 6,505,832 | B2 | 1/2003 | Moore et al. | |
| 2006/0222385 | A1 * | 10/2006 | Serita | 399/44 |

FOREIGN PATENT DOCUMENTS

| | | | |
|---|---|---|---|
| JP | 2005181779 | A * | 7/2005 |
| JP | 2008111923 | A * | 5/2008 |

* cited by examiner

*Primary Examiner* — Quana M Grainger
(74) *Attorney, Agent, or Firm* — Ronald E. Prass, Jr.; Prass LLP

(57) ABSTRACT

Disclosed are a method of controlling moisture in an electrophotographic apparatus having a fuser assembly, and corresponding electrophotographic apparatus. The method includes measuring a cavity temperature of an inner portion of the electophotographic apparatus, measuring a cavity relative humidity of an inner portion of the electophotographic apparatus, calculating a cavity dewpoint temperature using the measured cavity temperature and the measured cavity relative humidity, determining a difference between the cavity temperature and the cavity dewpoint temperature, and if the difference between the cavity temperature and the cavity dewpoint temperature drops below a predetermined threshold, turning on a heater device in the fuser assembly to control moisture in the electrophotographic apparatus.

20 Claims, 6 Drawing Sheets

METHODS FOR CONTROLLING ENVIRONMENTAL CONDITIONS IN AN ELECTROPHOTOGRAPHIC APPARATUS AND A CORRESPONDING ELECTROPHOTOGRAPHIC APPARATUS

BACKGROUND

Disclosed are methods for controlling environmental conditions in an electrophotographic apparatus, and a corresponding apparatus.

In a typical electrophotographic or electrostatographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited as latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat and pressure, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

Moisture within the apparatus can cause harm to the developer material (toner), which if not controlled can induce problems such as permanently low conductivity causing light copies. It would be desirable to reduce the onset rate of these problems by controlling environmental conditions such as the moisture level within the electrophotographic apparatus.

SUMMARY

According to aspects of the embodiments, there is provided a method of controlling moisture in an electrophotographic apparatus having a fuser assembly, and corresponding electrophotographic apparatus. The method includes measuring a cavity temperature of an inner portion of the electophotographic apparatus, measuring a cavity relative humidity of an inner portion of the electophotographic apparatus, calculating a cavity dewpoint temperature using the measured cavity temperature and the measured cavity relative humidity, determining a difference between the cavity temperature and the cavity dewpoint temperature, and if the difference between the cavity temperature and the cavity dewpoint temperature drops below a predetermined threshold, turning on a heater device in the fuser assembly to control moisture in the electrophotographic apparatus.

DETAILED DESCRIPTION

Figure 1:
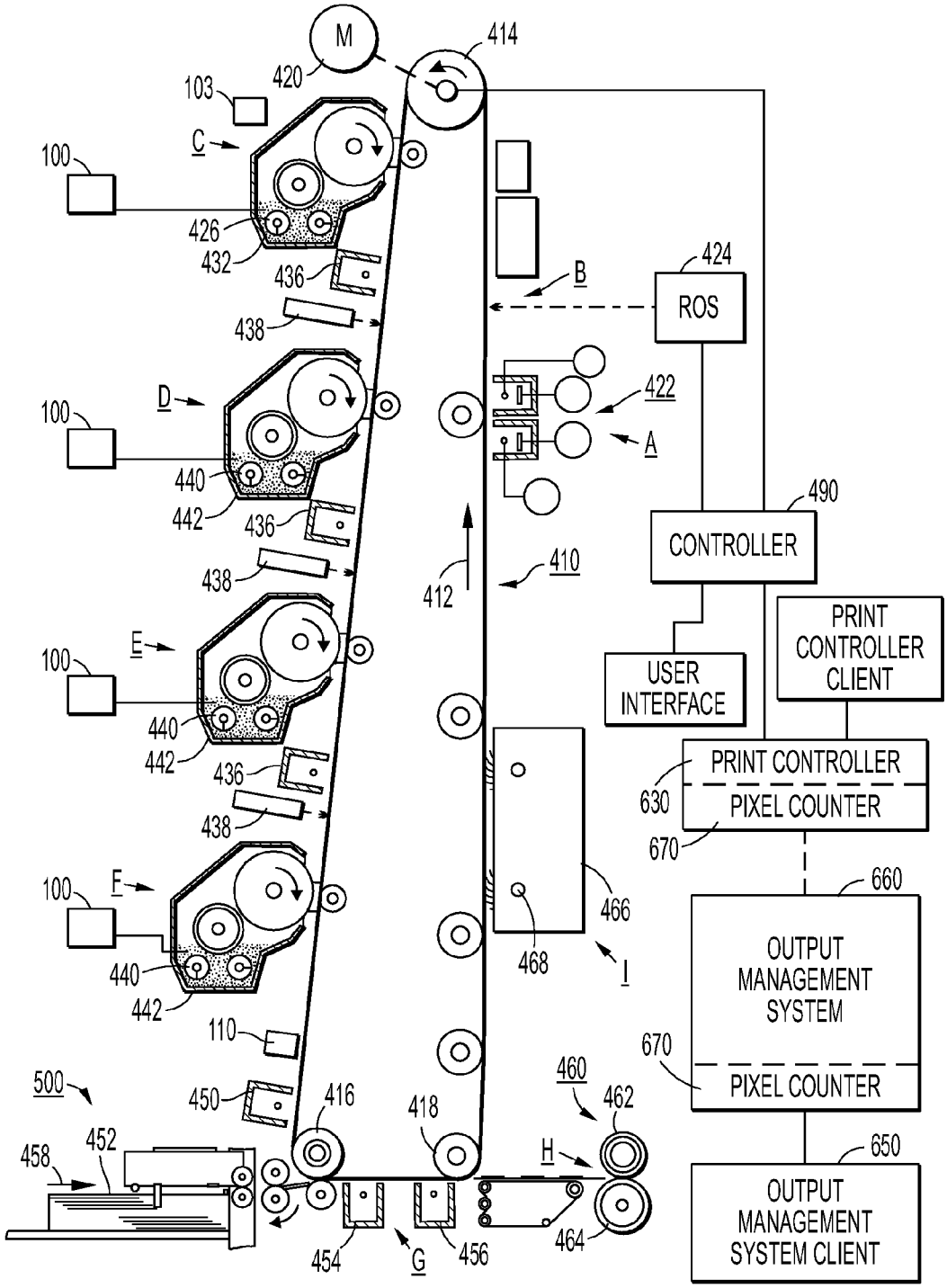
FIG. 1 illustrates a schematic view of a digital imaging system.

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The embodiments include a method of controlling moisture in an electrophotographic apparatus, the electrophotographic apparatus having a fuser assembly. The method includes measuring a cavity temperature of an inner portion of the electophotographic apparatus, measuring a cavity relative humidity of an inner portion of the electophotographic apparatus, calculating a cavity dewpoint temperature using the measured cavity temperature and the measured cavity relative humidity, determining a difference between the cavity temperature and the cavity dewpoint temperature, and if the difference between the cavity temperature and the cavity dewpoint temperature drops below a predetermined threshold, turning on a heater device in the fuser assembly to control moisture in the electrophotographic apparatus.

The embodiments further include an electrophotographic apparatus having a developer housing with developer material stored therein, a fuser assembly having a heater device, and a controller that receives a measured cavity temperature of an inner portion of the electophotographic apparatus and a measured cavity relative humidity of an inner portion of the electophotographic apparatus, wherein the controller calculates a cavity dewpoint temperature using the measured cavity temperature and the measured cavity relative humidity, determines a difference between the cavity temperature and the cavity dewpoint temperature, and if the difference between the cavity temperature and the cavity dewpoint temperature drops below a predetermined threshold, turns on the heater device in the fuser assembly to control moisture in the electrophotographic device.

The embodiments further include an electrophotographic apparatus having a developer housing with developer material stored therein, a fuser assembly having a heater device, and a controller that receives a measured cavity temperature of an inner portion of the electophotographic apparatus and a measured cavity relative humidity of an inner portion of the electophotographic apparatus, wherein the controller calculates a cavity dewpoint temperature using the measured cavity temperature and the measured cavity relative humidity, determines a difference between the cavity temperature and the cavity dewpoint temperature, and if the difference between the cavity temperature and the cavity dewpoint temperature drops below a predetermined threshold, turns on the heater device in the fuser assembly to control moisture in the electrophotographic device and causes charging of the developer material in the developer, wherein the controller controls the heater device to remain on until the cavity temperature is above the dewpoint temperature by a desired amount.

In as much as the art of electrophotographic printing is well known, the various processing stations employed in the FIG. 1 printing machine will be shown hereinafter schematically and their operation described briefly with reference thereto. Various other printing machines could also be used, and this is only an example of a particular printing machine that may be used with the invention.

FIG. 1 is a partial schematic view of a digital imaging system, such as the digital imaging system of U.S. Pat. No. 6,505,832, which is hereby incorporated by reference. The imaging system is used to produce an image such as a color image output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of photoreceptor belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432. A sensor 103 measures temperature and relative humidity, and directs the measured values to controller 490 or to another controller. Alternatively, separate sensors could be used to measure temperature and relative humidity, and one or more sensors adjacent each development station could be used. A motor 100 may be used to charge the toner.

The developed but unfixed image is then transported past a second charging device 436 where the photoreceptor belt 410 and previously developed toner image areas are recharged to a predetermined level.

A second exposure/imaging is performed by device 438 which comprises a laser based output structure which is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor 600 which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and pressure roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator. The fuser assembly 460 may be contained within a cassette, and may include additional elements not shown in this figure, such as a belt around the fuser roller 462, or additional heating elements, such as heat lamps, heated rollers, or the like. The heating at the fuser assembly may be controlled by controller 490, or by another controller.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The foregoing description illustrates the general operation of an electrophotographic printing machine incorporating the development apparatus of the present disclosure therein. Not all of the elements discussed in conjunction with FIG. 1 are necessarily needed for effective use of the invention. Instead, these elements are described as a machine within which embodiments of the invention could operate.

Figure 2:
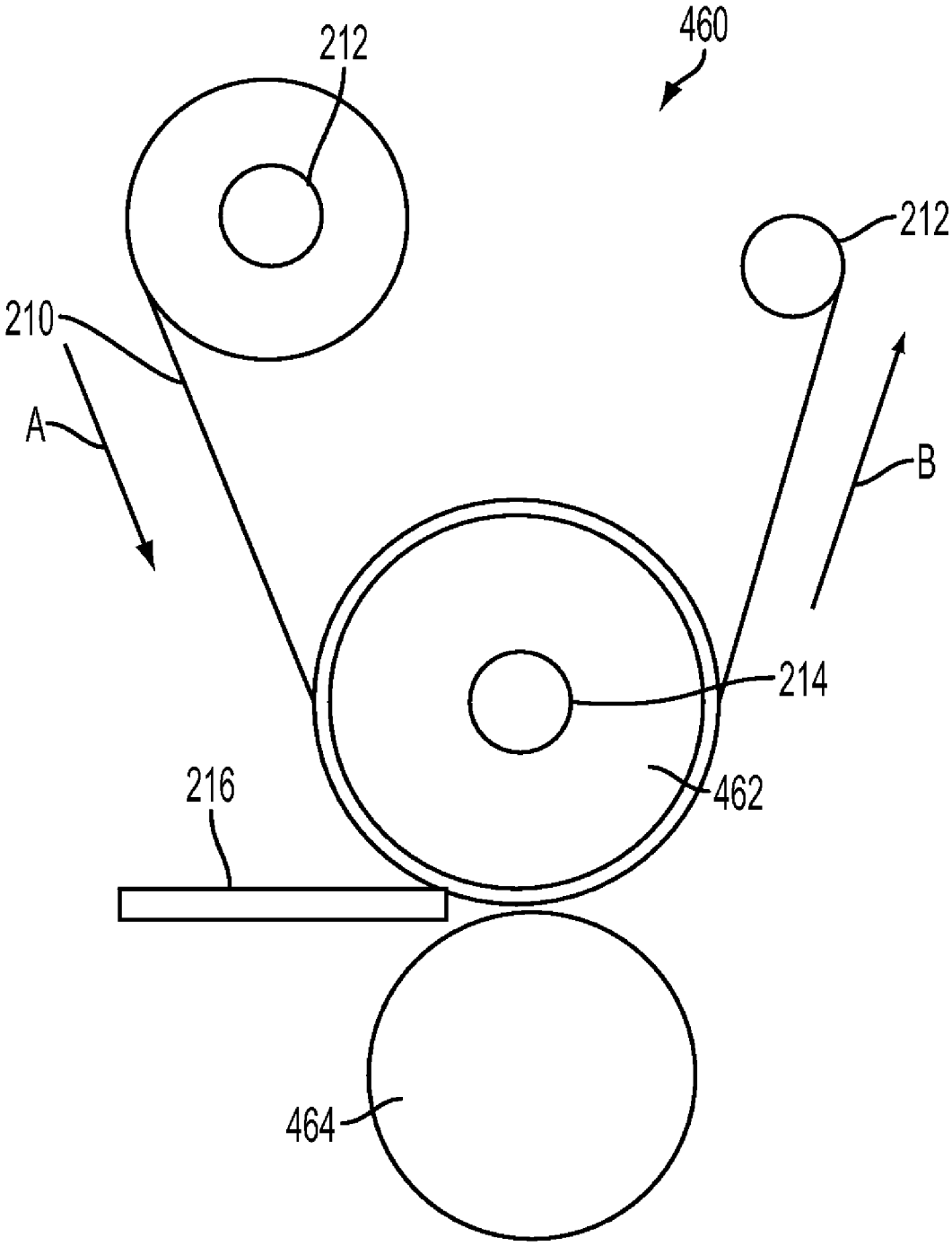
FIG. 2 illustrates a diagram of a fuser assembly.

FIG. 2 illustrates the fuser assembly 460 in greater detail. The fuser assembly 460 includes the fuser roller 462, the pressure roller 464, fuser belt 210, belt rollers 212, and heating element 214. The fuser assembly 460 may be within a cassette or other housing (not shown). The fuser belt 210 may be driven by a motor (not shown) such as a stepper motor, for example. Media sheet 216 may come into contact with fuser roller 210 to accomplish the fusing process. The fuser belt 210 may be replaced by an endless fuser belt or the like.

The belt rollers 212 may be heated, cooled or heat-pipe like rollers, which may act to mitigate both axial and process direction temperature deltas. The heating and cooling may be controlled by processor 490. The heating in the fuser assembly 460 may be accomplished by a heating element such as heating element 214, heating elements associated with the belts or rollers, or any other heating element.

Typically, the heating element is activated during the fusing process. However, in accordance with the present invention, the heating element is activated when the electrophotographic apparatus detects that a cavity dewpoint temperature within the electrophotographic apparatus has dropped to a point where it could adversely affect the quality of subsequent printing.

Figure 3:
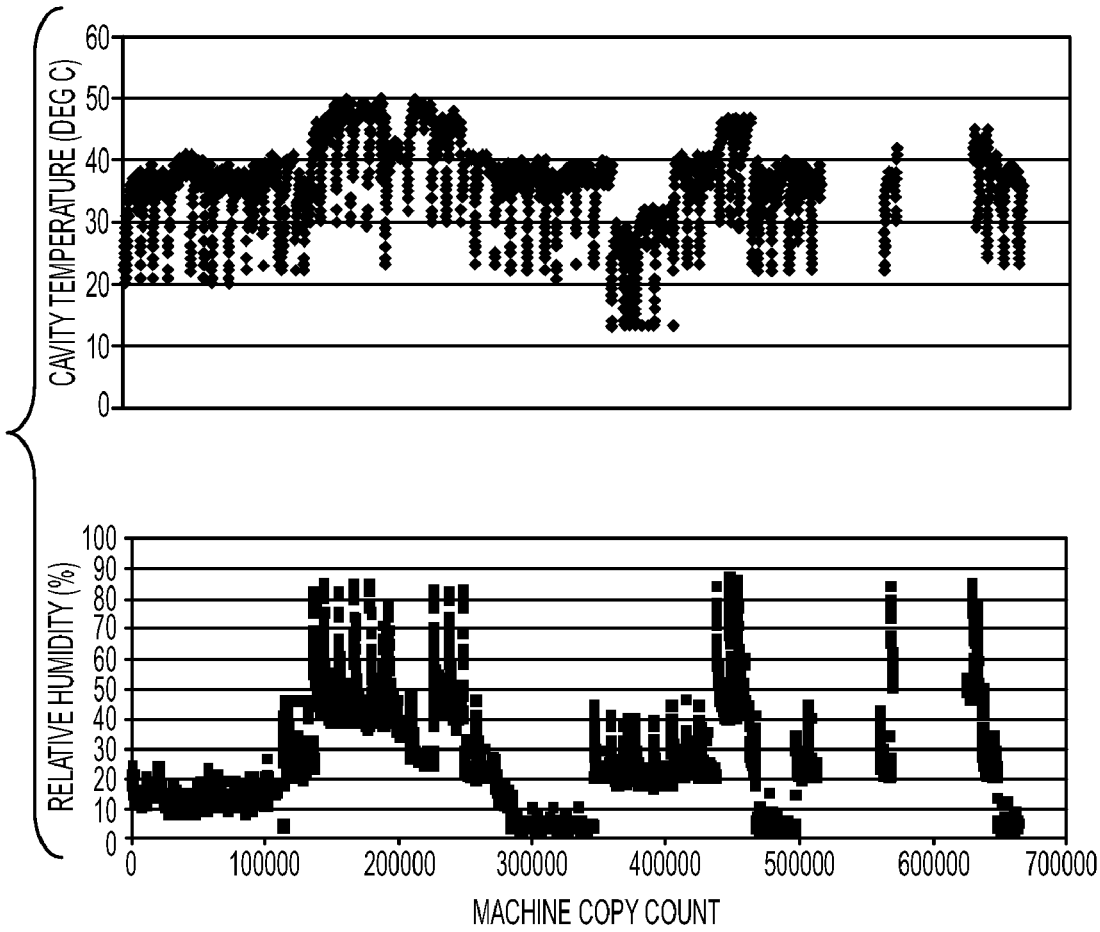
FIG. 3 illustrates a chart of cavity temperature and cavity relative humidity.

FIG. 3 illustrates cavity temperature and relative humidity (RH) collected from an electrophotographic apparatus during run. Conditions during the test varied, with the relative humidity of the room in which the measurements were made varying between 5% and 80% RH. During a typical day, heat from the fuser causes the internal cavity temperature to rise and the relative humidity to decrease. The measurements were made internal to the electrophotographic housing adjacent to the developer housing over approximately one month. The spikes in humidity occur when the fuser cools down from non-use, such as when the apparatus may be off at night or when the apparatus is not in use. If left unchecked, this high humidity could cause degradation in developer material.

Figure 4:
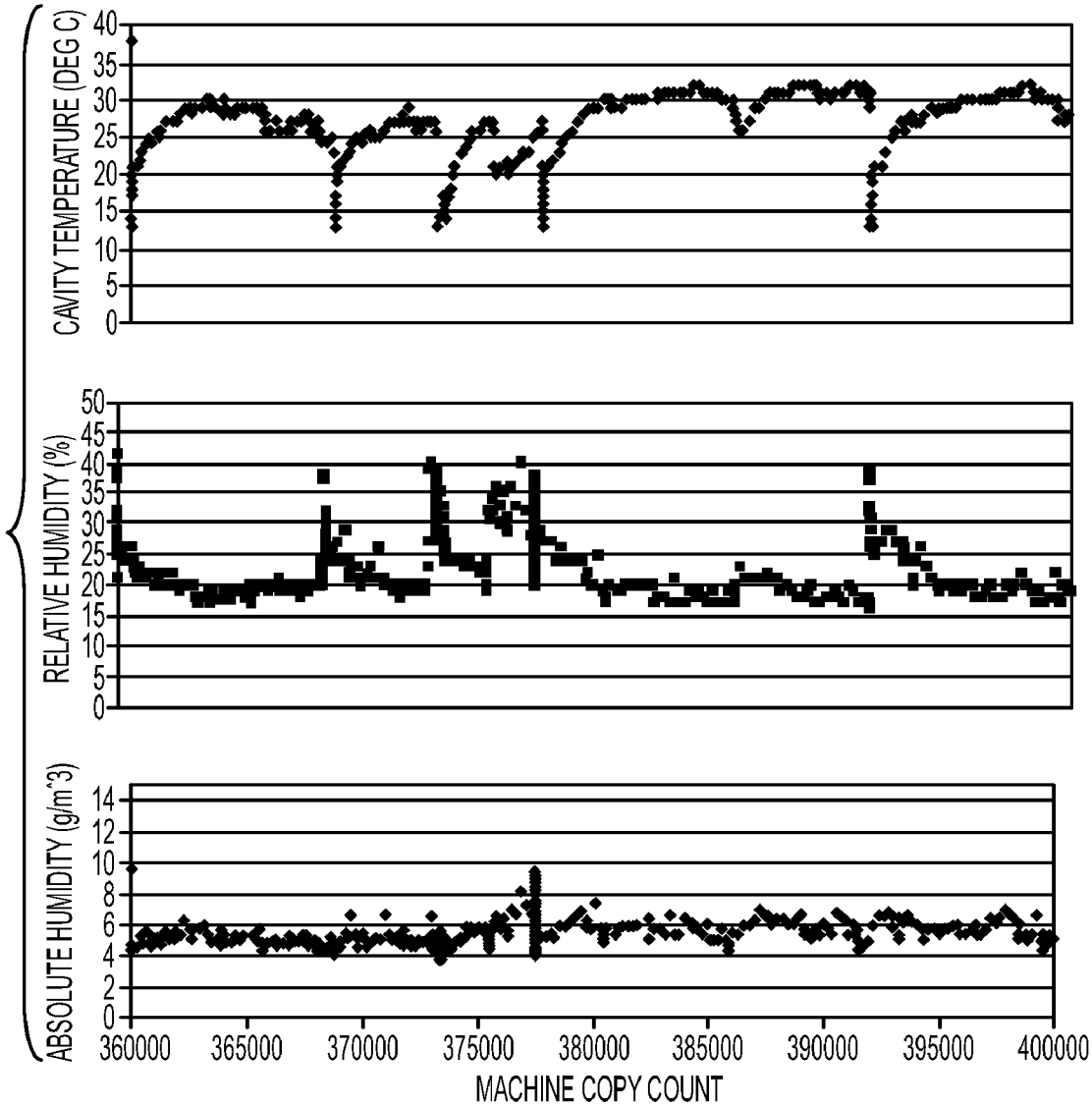
FIG. 4 illustrates a chart of cavity temperature, cavity relative humidity, and absolute humidity.

FIG. 4 illustrates cavity temperature, relative humidity, and absolute humidity of an electrophotographic apparatus over a period of five days. The cavity temperature and the relative humidity were measured with a device such as sensor 103, and the absolute humidity was calculated. As may be seen from this figure, during periods when the cavity temperature dropped, the relative humidity correspondingly increased. The absolute humidity is calculated from commonly available equations. For example, the gas law equation: D=P/(T*R) may be used where P=pressure in Pascals Pa), D=density(kg/m3), T=temperature in degrees Kelvin, R=gas constant for air=287 (J/kg*Kelvin), and Rw=gas constant for water vapor=461.5 (J/kg*Kelvin). Absolute humidity is the density of water vapor in the air (kg/m3). To calculate absolute humidity, you must first use the dewpoint temperature Tdc and the formula for saturation vapor pressure Es, Es=6.11*10.0**(7.5*Tdc/(237.7+Tdc)) to calculate saturation vapor pressure in millibars. Then convert the vapor pressure in millibars to Pa by multiplying by 100. Once you have the saturation vapor pressure in Pa, you can use the gas law discussed above to calculate water vapor density (i.e. absolute humidity) by substituting Rw in place of R and by using the vapor pressure in the gas law formula, rather than the total atmospheric pressure that you would use to calculate air density.

The dewpoint temperature Tdc may be calculated from: Tdc=(430.22+237.7*ln(E))/(−ln(E)+19.08), where E is the actual vapor pressure. The actual vapor pressure may be calculated from E=(RH*Es)/100 and Es=6.11*10.0**(7.5*Tc/(237.7+Tc)), where Es is the saturation vapor pressure, RH is the relative humidity, and Tc is the air temperature celsius. By measuring the air temperature and relative humidity, the dewpoint temperature may be calculated.

Figure 5:
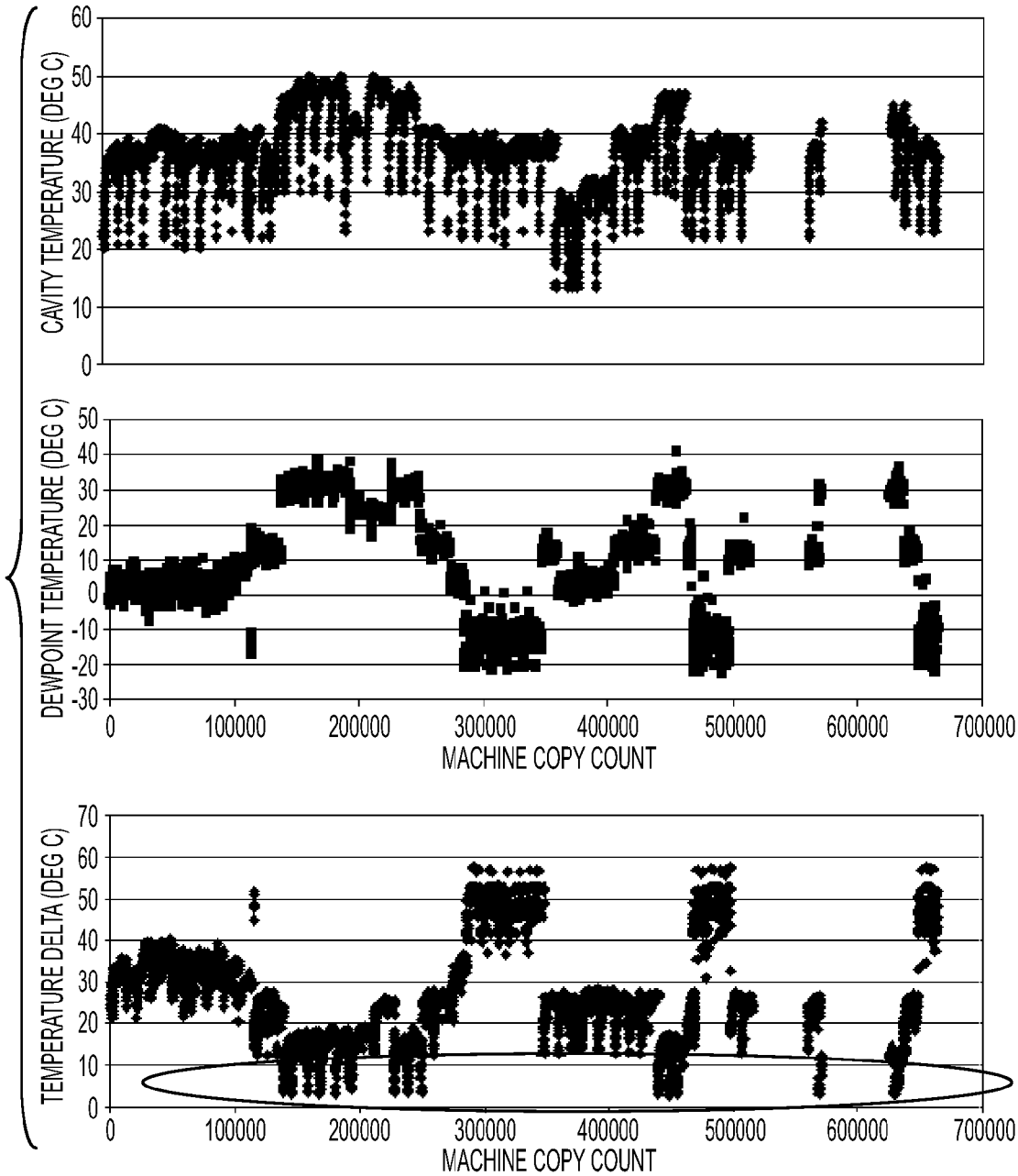
FIG. 5 illustrates a chart of cavity temperature, dewpoint temperature and a difference between cavity temperature and dewpoint temperature.

FIG. 5 illustrates the cavity temperature, the calculated dewpoint temperature, and the difference between the cavity temperature and the dewpoint temperature. Embodiments of the invention monitor the difference between the cavity temperature and the dewpoint temperature. If the difference drops below a predetermined threshold, the embodiments turn on a heater device in the fuser assembly to raise the cavity temperature and thus avoid moisture from forming inside the electrophotographic device. The embodiments monitor this temperature difference at all times, including when the apparatus may be in a sleep mode.

Any predetermined threshold may be used for the threshold difference between the cavity temperature and the dewpoint temperature. However, a preferred temperature threshold may be five degrees Celsius. In this preferred embodiment, if the difference between the cavity temperature and the dewpoint temperature drops below five degrees Celsius, the processor or controller will cause the heater device in the fuser assembly to turn on and raise the cavity temperature, thus avoiding moisture from forming inside the electrophotographic device. The heater device may be controlled to stay on until the cavity temperature rises sufficiently above the dewpoint temperature. For example, the heater device may be controlled to stay on until the cavity temperature rises to ten degrees Celsius above the dewpoint temperature, or to another desired amount above the dewpoint temperature.

The measurements may be made within a cavity of the electrophotographic apparatus. In preferred embodiments, the measurements may be made adjacent to a developer housing of the electrophotographic apparatus. For example, a sensor disposed adjacent to a developer housing may be used to make the needed measurements. If the electrophotographic apparatus has more than one developer housing, the measurements may be taken adjacent to one of the developer housings only, or additional sensors could be employed.

As an additional measure to protect the developer material from moisture, embodiments may charge developer material in the developer housing if the difference between the cavity temperature and the cavity dewpoint temperature drops below the predetermined threshold. The charging may involve turning on a motor in the developer, for example.

Figure 6:
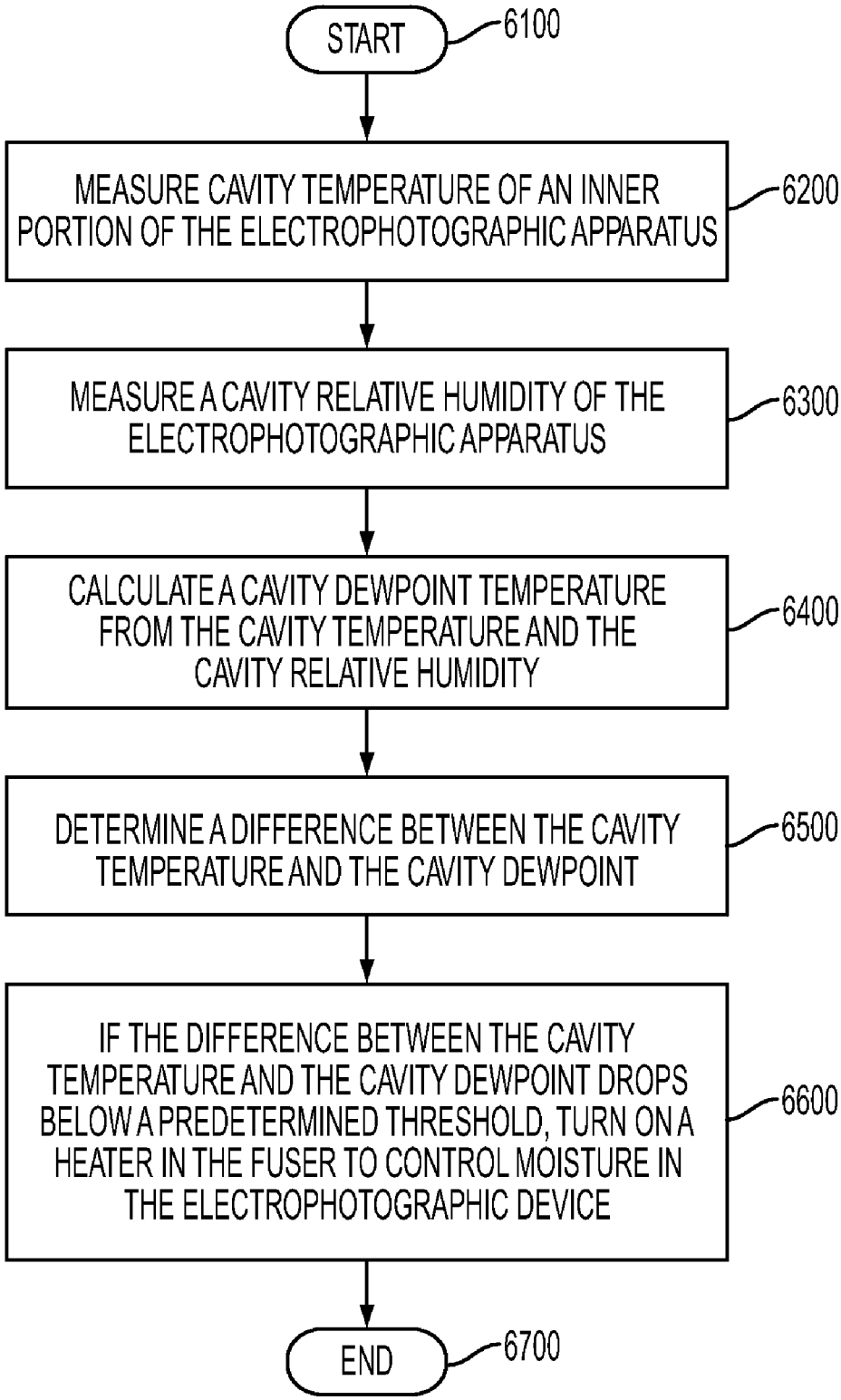
FIG. 6 illustrates a flowchart of a method of controlling moisture in an electrophotographic apparatus.

FIG. 6 illustrates a flowchart of a method of controlling moisture in an electrophotographic apparatus, the electrophotographic apparatus having a fuser assembly. The method starts at 6100. At 6200, a cavity temperature of an inner portion of the electophotographic apparatus is measured.

At 6300, a cavity relative humidity of an inner portion of the electophotographic apparatus is measured. At 6400, a cavity dewpoint temperature is calculated using the measured cavity temperature and the measured cavity relative humidity.

At 6500, a difference between the cavity temperature and the cavity dewpoint temperature is determined. At 6600, if the difference between the cavity temperature and the cavity dewpoint temperature drops below a predetermined threshold, turning on a heater device in the fuser assembly is turned on to control moisture in the electrophotographic device. At 6700, the method ends.

Embodiments as disclosed herein may include computer-readable medium for carrying or having computer-executable instructions or data structures stored thereon. Such computer-readable medium can be any available medium that can be accessed by a general purpose or special purpose computer. By way of example, and not limitation, such computer-readable medium can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable medium.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. The instructions for carrying out the functionality of the disclosed embodiments may be stored on such a computer-readable medium.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of controlling moisture in an electrophotographic apparatus, the electrophotographic apparatus having a fuser assembly, comprising:

measuring a cavity temperature of an inner portion of the electophotographic apparatus;

measuring a cavity relative humidity of an inner portion of the electophotographic apparatus;

calculating a cavity dewpoint temperature using the measured cavity temperature and the measured cavity relative humidity;

determining a difference between the cavity temperature and the cavity dewpoint temperature; and if the difference between the cavity temperature and the cavity dewpoint temperature drops below a predetermined threshold, turning on a heater device in the fuser assembly to control moisture in the electrophotographic device.

2. The method of claim 1, wherein the predetermined threshold is 5 degrees Celsius.

3. The method of claim 2, wherein the heater device remains on until the cavity temperature is above the dewpoint temperature by a desired amount.

4. The method of claim 1, wherein the electrophotographic apparatus includes a developer having a developer housing, and the cavity temperatue and the cavity relative humidity are measured adjacent to the developer housing.

5. The method of claim 4, wherein the cavity temperature and the cavity relative humidity are both measured with a sensor located adjacent to the developer housing.

6. The method of claim 1, further comprising charging developer material in the developer housing if the difference between the cavity temperature and the cavity dewpoint temperature drops below the predetermined threshold.

7. The method of claim 6, wherein charging the developer material comprises turning on a motor of the developer.

8. An electrophotographic apparatus, comprising:

a developer having a developer housing with developer material stored therein;

a fuser assembly having a heater device; and a controller that receives a measured cavity temperature of an inner portion of the electophotographic apparatus and a measured cavity relative humidity of an inner portion of the electophotographic apparatus, wherein the controller calculates a cavity dewpoint temperature using the measured cavity temperature and the measured cavity relative humidity, determines a difference between the cavity temperature and the cavity dewpoint temperature, and if the difference between the cavity temperature and the cavity dewpoint temperature drops below a predetermined threshold, turns on the heater device in the fuser assembly to control moisture in the electrophotographic device.

9. The electrophotographic apparatus of claim 8, wherein the predetermined threshold is 5 degrees Celsius.

10. The electrophotographic apparatus of claim 9, wherein the controller controls the heater device to remain on until the cavity temperature is above the dewpoint temperature by a desired amount.

11. The electrophotographic apparatus of claim 8, wherein the cavity temperature and the cavity relative humidity are measured adjacent to the developer housing.

12. The electrophotographic apparatus of claim 11, further comprising a sensor located adjacent to the developer housing, wherein the sensor measures the cavity temperature and the cavity relative humidity.

13. The electrophotographic apparatus of claim 8, wherein the controller causes charging of the developer material in the developer if the difference between the cavity temperature and the cavity dewpoint temperature drops below the predetermined threshold.

14. The electrophotographic apparatus of claim 13, wherein the developer includes a motor for charging the developer material, and the controller causes charging of the developer material by turning on the motor.

15. An electrophotographic apparatus, comprising:

a developer having a developer housing with developer material stored therein;

a fuser assembly having a heater device; and a controller that receives a measured cavity temperature of an inner portion of the electophotographic apparatus and a measured cavity relative humidity of an inner portion of the electophotographic apparatus, wherein the controller calculates a cavity dewpoint temperature using the measured cavity temperature and the measured cavity relative humidity, determines a difference between the cavity temperature and the cavity dewpoint temperature, and if the difference between the cavity temperature and the cavity dewpoint temperature drops below a predetermined threshold, turns on the heater device in the fuser assembly to control moisture in the electrophotographic device and causes charging of the developer material in the developer, wherein the controller controls the heater device to remain on until the cavity temperature is above the dewpoint temperature by a desired amount.

16. The electrophotographic apparatus of claim 15, wherein the predetermined threshold is 5 degrees Celsius.

17. The electrophotographic apparatus of claim 15, further comprising a sensor located adjacent to the developer housing for measuring the cavity temperature and the cavity relative humidity.

18. The electrophotographic apparatus of claim 15, wherein the developer includes a motor for charging the developer material.

19. The method of claim 1, wherein the heater device remains on until the cavity temperature rises to ten degrees Celsius above the dewpoint temperature.

20. The electrophotographic apparatus of claim 8, wherein the controller controls the heater device to remain on until the cavity temperature rises to ten degrees Celsius above the dewpoint temperature.

* * * * *